US007845643B2

(12) United States Patent
Gram, Jr.

(10) Patent No.: US 7,845,643 B2
(45) Date of Patent: Dec. 7, 2010

(54) MULTI-GAME DECK OF PLAYING CARDS

(75) Inventor: Reed K. Gram, Jr., Hampton, VA (US)

(73) Assignee: Cydewl, LLC, Hampton, VA (US)

( * ) Notice: Subject to any disclaimer, the term of this patent is extended or adjusted under 35 U.S.C. 154(b) by 0 days.

(21) Appl. No.: 12/322,672

(22) Filed: Feb. 5, 2009

(65) Prior Publication Data

US 2010/0194045 A1 Aug. 5, 2010

(51) Int. Cl.
*A63F 1/00* (2006.01)

(52) U.S. Cl. ..... 273/292; 273/296; 273/303; 273/304; D21/378; D21/379

(58) Field of Classification Search ..... 273/296, 273/299, 303–307, 292; D21/378, 379
See application file for complete search history.

(56) References Cited

U.S. PATENT DOCUMENTS 298,991 A * 5/1884 Levey ..... 273/305
1,551,761 A * 9/1925 McCarroll ..... 273/304
1,559,813 A * 11/1925 Van Benthuysen ..... 273/306
1,775,782 A * 9/1930 Pearson ..... 273/304
2008/0176617 A1* 7/2008 Kekempanos et al. ..... 463/13

* cited by examiner

*Primary Examiner*—Benjamin H Layno
(74) *Attorney, Agent, or Firm*—Peter J. Van Berge

(57) ABSTRACT

Each of fifty-two playing cards has upper and lower portions when the card is in a selected orientation. Each card has a first face side with two numbers visible on its upper portion and the same two numbers visible on its lower portion. The two numbers are vertically oriented with respect to one another, are arranged in an identical order on the card's upper and lower portions, and are right side up on the card's upper portion and upside down on the card's lower portion. Each the two numbers is between 1 and 13, and is red or black.

20 Claims, 3 Drawing Sheets

MULTI-GAME DECK OF PLAYING CARDS

FIELD OF THE INVENTION

The invention relates generally to playing cards, and more particularly to a deck of playing cards with each card having two numbers printed on one side thereof for use in a variety of unique games.

BACKGROUND OF THE INVENTION

The well-known standard deck of playing cards consists of fifty-two cards. One side of each card is generally the same design throughout the deck with the design having no significance to any game that is played with the deck of cards. The other "face" side of each card is printed as one card from the conventional four-suit, ace-through-king scheme. The standard deck of playing cards is the basis for a number of well-known games for pleasure and games of chance. However, the general public is always in search of new games that must also be simple if they are to become popular.

SUMMARY OF THE INVENTION

Accordingly, it is an object of the present invention to provide a deck of playing cards that supports a variety of new games.

Another object of the present invention is to provide a deck of playing cards that can be used to play a number of simple games.

Other objects and advantages of the present invention will become more obvious hereinafter in the specification and drawings.

In accordance with the present invention, a deck of playing cards has fifty-two cards. Each card has an upper portion and a lower portion when the card is in a selected orientation. Each card has a first face side with two numbers visible on its upper portion and the same two numbers visible on its lower portion. For each card in the selected orientation, the two numbers are (i) defined in a vertical orientation with respect to one another, (ii) arranged in an identical order on its upper portion and on its lower portion, and (iii) right side up on its upper portion and upside down on its lower portion. Further, for each card, each of its two numbers is (i) selected from the group consisting of the numbers 1 through 13, and (ii) a color selected from the group consisting of red and black.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

The deck of playing cards in the present invention will provide the users thereof a large variety of new and simple games. A few of these games will be described herein. However, it is to be understood that the described games do not limit the present invention as they are merely illustrative of the present invention's versatility.

In general, the present invention's deck of playing cards consists of fifty-two cards, or the same number as a conventional deck of four-suit, ace-through-king cards. The size, shape (e.g., rectangular), thickness, and materials used to make the present invention's deck of playing cards can be the same/similar to those used to make a conventional deck of playing cards. In this way, the present invention's deck of playing cards will provide the users thereof a familiar "feel" thereby greatly reducing the trepidation typically associated with trying something new. However, it is to be understood that the present invention can also be practiced using cards that are unconventional in terms of their size, shape, thickness and/or materials without departing from the inventive principles of the present invention.

Figure 1:
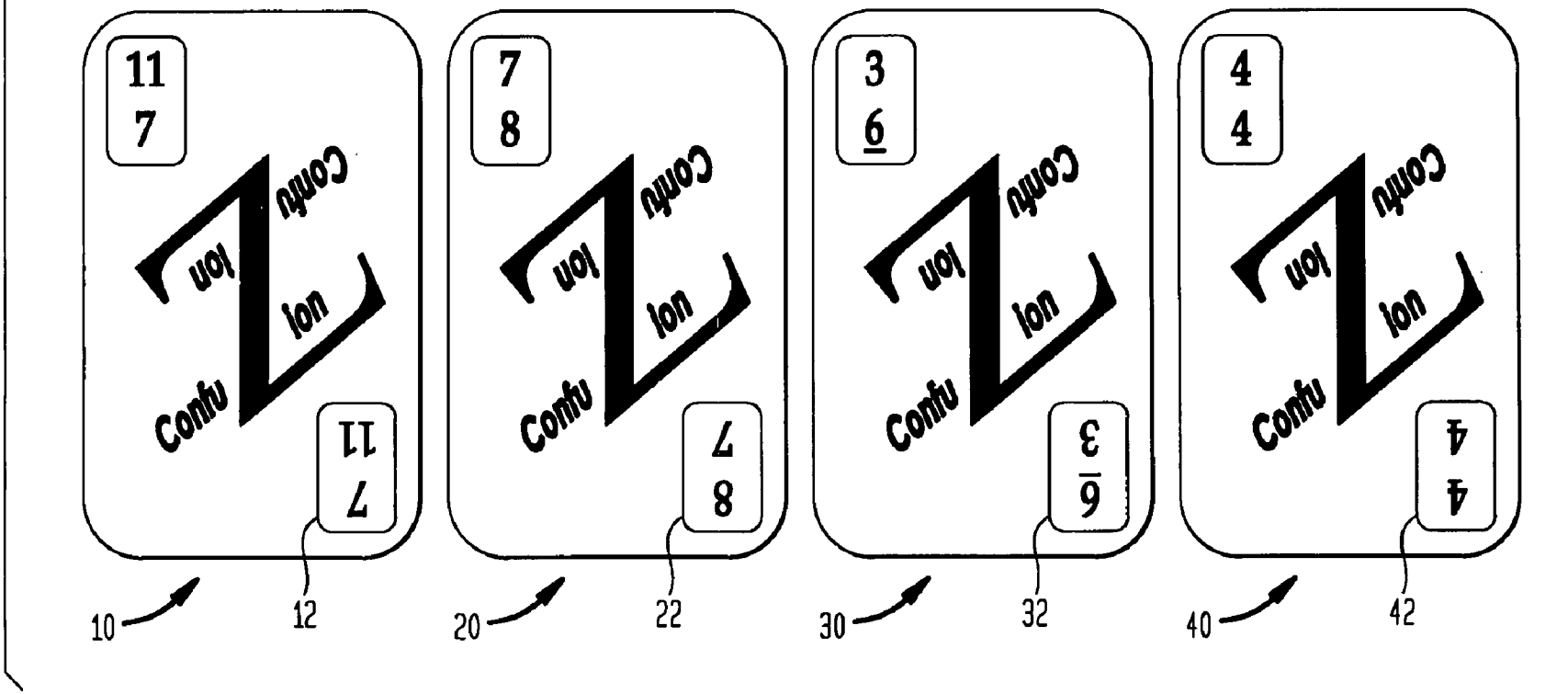
FIG. 1 is a plan view of four cards from a deck of playing cards illustrating a face side thereof in accordance with the present invention.

Referring now to the drawings and more particularly to FIG. 1, face sides of four cards from a deck of playing cards of the present invention are illustrated where the cards are referenced by numerals 10, 20, 30 and 40. It is to be understood that the particular numbers shown on cards 10-40 are not limitations thereof, but are merely illustrative of possible combinations from a numbering scheme utilized by the present invention.

As mentioned above, cards 10-40 of the present invention can be made to feel like a conventional deck of playing cards. Accordingly, cards 10-40 are rectangular and are displayed in their vertical orientation as would typically be the case when held by a user/player (not shown). In the illustrated vertical orientation, each of cards 10-40 has upper, central and lower portions as would be readily understood by one of ordinary skill in the art. The central portion of each card can depict a design (e.g., the name and/or logo associated with the deck of cards), the choice of which is not a limitation of the present invention.

The upper and lower portions of each card 10-40 depict two numbers that are the same for a given card. For example, card 10 depicts the numbers "11" and "7," card 20 depicts the numbers "7" and "8," card 30 depicts the numbers "3" and "6," and card 40 depicts the numbers "4" and "4." In the illustrated embodiment, the numbers depicted on the upper portion of a card are on the left hand side thereof while the numbers depicted on the lower portion of a card are on the right hand side thereof. This facilitates viewing the numbers when the cards are held in one hand. This will be true even if a card is rotated 180° in the plane of the card to its reverse vertical orientation. However, it is to be understood that the numbers could also be placed on, for example, the middle region of the upper/lower portions of a card without departing from the scope of the present invention. It is further to be understood that the banner 12, 22, 32 and 42 used to highlight the numbers on cards 10-40, respectively, is not a requirement or limitation of the present invention.

The following features are maintained for each of cards 10-40 as well as the remaining forty-eight cards in the deck of the present invention. First, the numbers on a card (e.g., numbers "11" and "7" on card 10) are substantially vertically aligned with one another when the card is in either of its two possible vertical orientations. Next, the "top-to-bottom" order of the two numbers on a card is the same for both the upper and lower portions of the card when the card is held in either of its two possible vertical orientations. For example, the number "7" is above the number "8" on card 20 for both the upper and lower portions of the card in the illustrated vertical orientation. However, when card 20 is rotated to its second vertical orientation, the order of the two numbers is reversed. That is, for card 20 rotated to its second vertical orientation, the number "8" will be above the number "7" on both the upper and lower portions of the card. Further, the numbers appearing on the lower portion of a card (in either of its two vertical orientations) are upside down. This "top-to-bottom" order feature is maintained for each card in each of its two possible vertical orientations.

An exemplary numbering scheme for the present invention's deck of playing cards will now be described. In general, the two numbers on any given playing card of the present invention are selected from the numbers from 1 to 13. The numbers can be different (e.g., cards 10, 20 and 30) or the same (e.g., card 40). The color of a particular number is either red or black. For a given card, both numbers could be red (e.g., assume "11" and "7" are red for card 10), both numbers could be black (e.g., assume "7" and "8" are black for card 20), or one number could be red and one number could be black (e.g., assume "3" is black and "6" is red for card 30, and assume the top "4" is black and the lower "4" is red for card 40).

In accordance with an embodiment of the present invention, the numbers for the fifty-two cards of the present invention are selected as follows. Two conventional decks of four-suit, ace-through-king playing cards are shuffled together to form a double-deck of 104 cards. It is to be understood that the 104-card "deck" can be actual cards or a computerized equivalent. Two cards are randomly selected and used to set the numbers for a card in the present invention with the two selected cards then being eliminated from further consideration. The "Jack," "Queen," and "King," cards from the conventional decks represent the numbers "11," "12," and "13," respectively. Thus, for the cards 10-40, if a "Jack of hearts" and a "Seven of clubs" were selected, card 10 would be defined. Similarly, if an "Eight of spades" and a "Seven of spades" were selected, card 20 would be defined. Card 30 could be defined by selecting a "Three of clubs" and a "Six of diamonds" whereas card 40 could be defined by selecting a "Four of clubs" and a "Four of hearts." In each case, once the two cards are selected from the double-deck, they are eliminated from further consideration. The above process is repeated for all of the cards in the 104-card deck. As a result, each of numbers 1-13 will appear exactly eight times in a playing card deck of the present invention. Further exactly, half of the numbers 1-13 will be red and half will be black. It is to be understood that the present invention is not limited to the above-described number selection scheme as a wide variety of number selection schemes could be used without departing from the scope of the present invention.

The above-described numbering scheme can be used to print multiple decks of playing cards of the present invention with the multiple decks forming a version of the present invention. The random numbering-selection process can be repeated when a new version of the playing cards is to be produced. Thus, this numbering scheme provides the option of producing almost countless versions of the decks.

Figure 2:
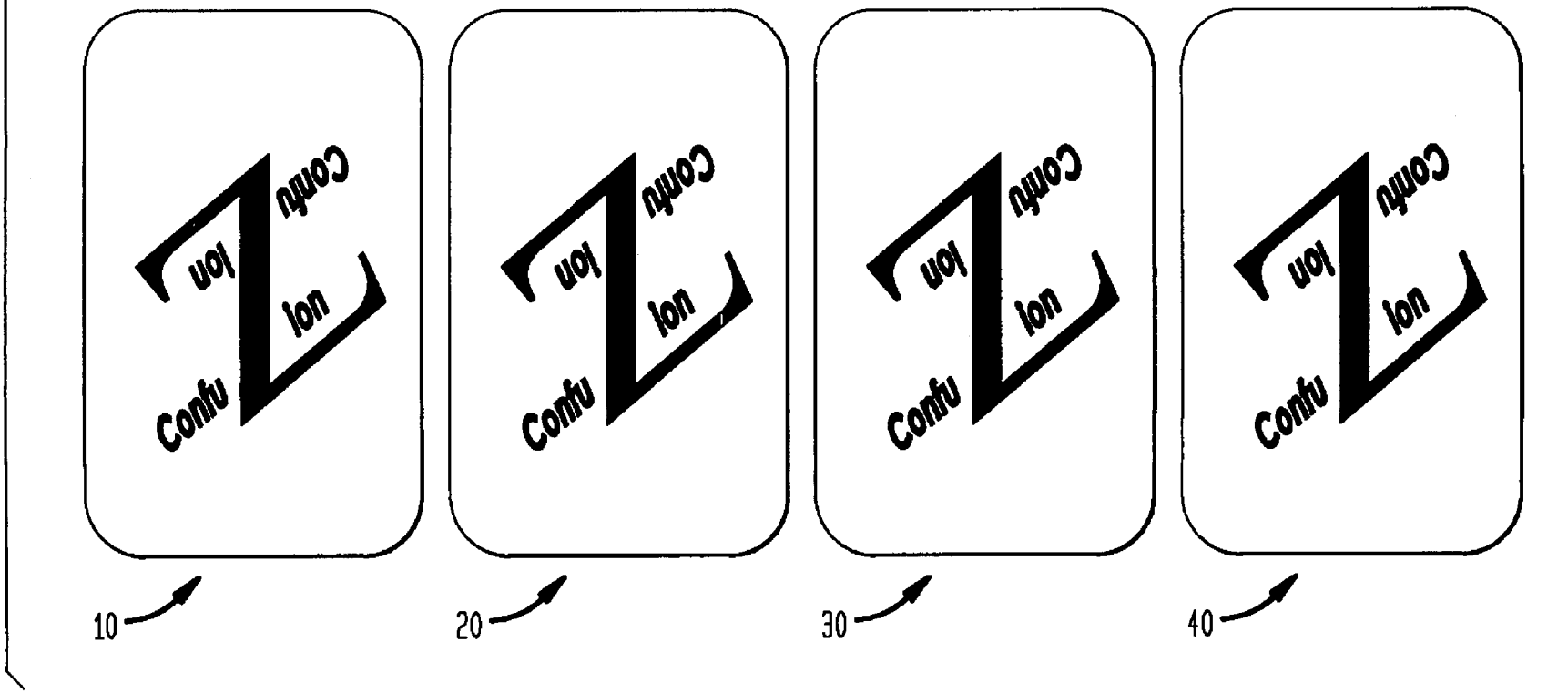
FIG. 2 is a plan view of the four cards in FIG. 1 illustrating the reverse side thereof where a common design is printed thereon accordance with an embodiment of the present invention.
Figure 3:
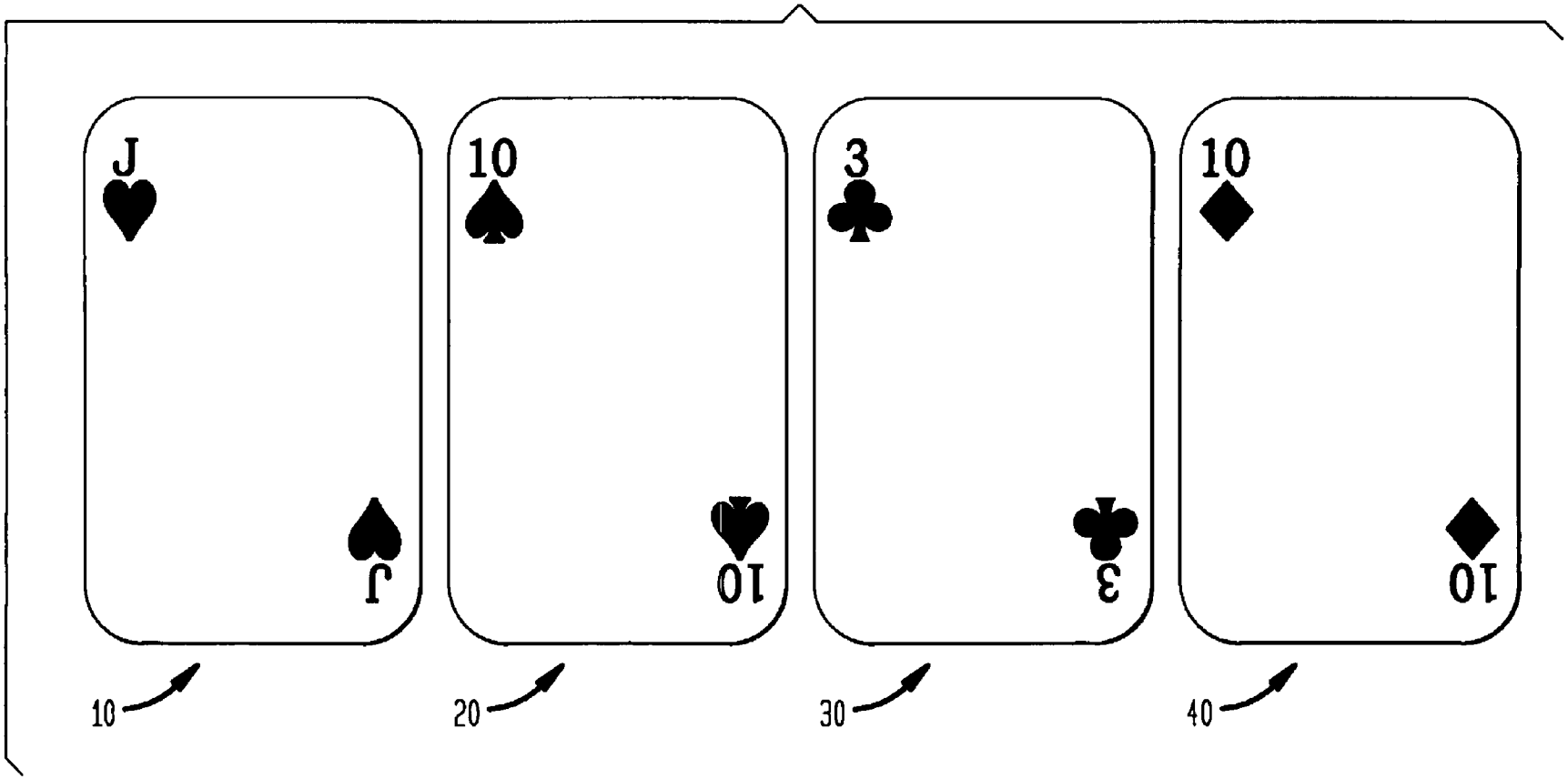
FIG. 3 is a plan view of the four cards in FIG. 1 illustrating the reverse side thereof where each card depicts a unique card from a conventional four-suit, ace-through-king playing card scheme in accordance with another embodiment of the present invention.

The reverse face side of each of cards 10-40 (as well as the remaining forty-eight cards) can have an identical design depicted thereon as illustrated in FIG. 2. However, the present invention is not so limited as FIG. 3 illustrates that the reverse face side of each of cards 10-40 can depict one of the unique cards from a conventional deck of playing cards. For example, the reverse side of card 10 depicts a "Jack of hearts," the reverse side of card 20 depicts a "Ten of spades" the reverse side of card 30 depicts a "Three of clubs," and the reverse side of card 40 depicts a "Ten of diamonds." In this way, the versatility of the present invention is expanded to conventional card games. Note that there is no correlation between the two numbers on one side of a card (FIG. 1) and the card/suit on the other side of a card (FIG. 3).

By way of example, three card games using the playing cards of the present invention will be explained below. In these descriptions, it is assumed that the "face" side of the card depicts the numbering scheme described above.

Game Number 1: Head to Head

Deal: Deal 5 cards "face" side down to each player. The remaining cards are placed face down in a "stock" pile.

Method of Play:

Player to left of the dealer chooses a card from his hand and places it "face" side down in front of him. Player declares the "Status" of the card they lay down, and then challenges any other player to choose a card from their hand and place it in front of them "face" side down. The "Status" of card refers to the two numbers at the top of the card played and is defined by Player as one of: Larger/Larger, Larger/Smaller, Smaller/Smaller or Smaller/Larger. Here, "Larger" and "Smaller" refer to Player's guess as to how the two numbers at the top of his card will compare to the two numbers at the top of the challenged player's card.

Both players turn their respective cards over face side up with the tops of the cards butting against each other. The top and bottom numbers at the abutting tops of the cards are compared. If both numbers compare as Player stated in "Status", Player keeps both of the cards. If neither of the numbers compare as Player stated in "Status", the challenged player keeps both cards. If the comparisons are split, each player keeps one card. In the case of top and/or bottom numbers matching, neither player gets a card for that play and the cards go into a "dead pile". Should the challenged player lay down a card where the numbers match exactly (excluding colors of the numbers), they win both cards automatically. Earned cards of each player are kept for later counting. Both players then select another card from the "stock" pile. Play then goes to the next player to the left and continues until all cards are used. Play continues until all cards are exhausted. When the "stock" pile is exhausted, play continues with cards available in the hands until they are gone. At the end of play, each player counts the amount of cards in front of them that they have "won" and records their "score".

End of Game: First Player to Reach 50 Wins.

Game Number 2: Nine Card Showdown

Deal: Deal 9 cards "face" side down to each player. The remaining portion of the deck is not used for the remainder of this hand.

Method of Play:

Players bid how many "tricks" they think they will take during the hand. A "trick" is defined when each player plays one card face up. Bidding begins by the player to the immediately to the left of the dealer and proceeds clockwise around the table. Bidding continues until no one wants to bid again. Players may change their bid, up or down, as the bidding rotation continues and players hear the other bids. Once bidding ends the player who first bid to take the most tricks, leads any card from their hand. The next player to the left plays any card from their hand they desire, either trying to take the trick or discarding a card they feel is useless. The played card that has the highest total value when the two numbers are combined takes the trick. If two or more cards total to the same value, they are both void and the trick goes to the player who played the next highest card. When play of the hand is complete, the players count the tricks taken during play of the hand. 10 points are awarded for each trick taken up to the player's bid number. 5 points are awarded for each trick taken over the player's bid. Points can be deducted when a player's bid number is greater than the number of tricks taken.

End of Game: First Player to Reach 200 Wins.

Game Number 3: Thirty-Four
Deal: Deal 5 cards to each player.

Method of Play:

Player to left of the dealer may lay a card in front of them face side up, or pass their play. Play continues to the next player to the left who has the same options as the previous player, and further has the option of playing a card on top of the card the player in front of them laid down. To play a card on top of one already on the table, it must be of the same numerical value (4 on a 4, 7 on a 7, etc.) regardless of color to form a "Group", or a numerical value 1 more than or 1 less than (and the same color) to form a "Run" (red 4-5-6, black 10-11-12, etc.). The third player must lay a card down in front of them. From there, each succeeding player has the same options, i.e., lay down a card, play on anyone else's cards, or pass their turn. Play continues until no one has a card in their hand. Players count the stacks of cards in front of them that is a "Group" or a "Run" of 3 or more cards. Each card in these stacks worth 1 point. Each card in any stack that does not contain 3 or more cards is worth (−1).

End of Game: First Player to Reach 100 Wins.

The advantages of the present invention are numerous. The two-number cards provide for numerous game playing options. The inclusion of conventional card printing on the flipside of the cards allows the deck of playing cards to be used for both conventional and new card games.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

The invention claimed is:

1. A deck of playing cards comprising fifty-two cards, each of said cards having an upper portion and a lower portion when said cards are in a selected orientation, each of said cards having a first face side with two numbers, a first number and a second number visible on said upper portion said first number and said second number visible on said lower portion wherein, for each of said cards in said selected orientation, said two numbers are (i) defined in a vertical orientation with respect to one another, (ii) arranged in an identical order on said upper portion and on said lower portion, wherein said first number is vertically oriented above said second number on said upper portion, and said first number is vertically oriented above said second number on said lower portion and (iii) right side up on said upper portion and upside down on said lower portion, and wherein, for each of said cards, each of said two numbers thereon is (i) selected from the group consisting of the numbers 1 through 13, (ii) a color selected from the group consisting of red and black, and wherein, throughout said deck, said two numbers are not limited to being a particular number's complementary numbers.

2. A deck of playing cards as in claim 1 wherein, throughout said deck, each of the numbers 1 through 13 comprises one of said two numbers exactly eight times.

3. A deck of playing cards as in claim 1 wherein, throughout said deck, said color comprises red for half of each of the numbers 1 through 13.

4. A deck of playing cards as in claim 1 wherein, for each of said cards in said selected orientation, said two numbers on said upper portion are on a left side thereof and said two numbers on said lower portion are on a right side thereof.

5. A deck of playing cards as in claim 1 wherein each of said cards has a second face side opposing said first face side, said second face side being identical for each of said cards in said deck.

6. A deck of playing cards as in claim 1 wherein each of said cards has a second face side opposing said first face side, said second face side being unique for each of said cards in said deck.

7. A deck of playing cards as in claim 1 wherein each of said cards has a second face side with indicia thereon representing one unique card from a deck of four-suit, ace-through-king playing cards, said second face side opposing said first face side.

8. A deck of playing cards comprising fifty-two identically-sized rectangular cards, each of said cards having an upper portion and a lower portion when said cards are in a vertical orientation, each of said cards having a first face side with two numbers, a first number and a second number visible on said upper portion, said first number and said second number visible on said lower portion wherein, for each of said cards in said vertical orientation, said two numbers are (i) arranged one above the other, (ii) arranged in an identical order on said upper portion and on said lower portion, wherein said first number is vertically oriented above said second number on said upper portion, and said first number is vertically oriented above said second number on said lower portion and (iii) right side up on said upper portion and upside down on said lower portion, and wherein, for each of said cards, each of said two numbers thereon is (i) selected from the group consisting of the numbers 1 through 13, (ii) a color selected from the group consisting of red and black, and wherein, throughout said deck, said two numbers are not limited to being a particular number's complementary numbers.

9. A deck of playing cards as in claim 8 wherein, throughout said deck, each of the numbers 1 through 13 comprises one of said two numbers exactly eight times.

10. A deck of playing cards as in claim 8 wherein, throughout said deck, said color comprises red for half of each of the numbers 1 through 13.

11. A deck of playing cards as in claim 8 wherein, for each of said cards in said vertical orientation, said two numbers on said upper portion are on a left side thereof and said two numbers on said lower portion are on a right side thereof.

12. A deck of playing cards as in claim 8 wherein each of said cards has a second face side opposing said first face side, said second face side being identical for each of said cards in said deck.

13. A deck of playing cards as in claim 8 wherein each of said cards has a second face side opposing said first face side, said second face side being unique for each of said cards in said deck.

14. A deck of playing cards as in claim 8 wherein each of said cards has a second face side with indicia thereon representing one unique card from a deck of four-suit, ace-through-king playing cards, said second face side opposing said first face side.

15. A deck of playing cards comprising fifty-two cards, each of said cards having an upper portion and a lower portion when said cards are in a selected orientation, each of said cards having a first face side with two numbers , a first number and a second number visible on said upper portion , said first number and said second number visible on said lower portion wherein, for each of said cards in said selected orientation, said two numbers are (i) defined in a vertical orientation with respect to one another, (ii) arranged in an identical order on said upper portion and on said lower portion, wherein said first number is vertically oriented above said second number on said upper portion, and said first number is vertically oriented above said second number on said lower portion and (iii) right side up on said upper portion and upside down on said lower portion, wherein, for each of said cards, each of said two numbers thereon is (i) selected from the group consisting of the numbers 1 through 13, (ii) a color selected from the group consisting of red and black, and wherein, throughout said deck, each of the numbers 1 through 13 comprises one of said two numbers exactly eight times, said two numbers are not limited to being a particular number's, complementary numbers, and said color comprises red for half of each of the numbers 1 through 13.

16. A deck of playing cards as in claim 15 wherein, for each of said cards in said selected orientation, said two numbers on said upper portion are on a left side thereof and said two numbers on said lower portion are on a right side thereof.

17. A deck of playing cards as in claim 15 wherein each of said cards has a second face side opposing said first face side, said second face side being identical for each of said cards in said deck.

18. A deck of playing cards as in claim 15 wherein each of said cards has a second face side opposing said first face side, said second face side being unique for each of said cards in said deck.

19. A deck of playing cards as in claim 15 wherein each of said cards has a second face side with indicia thereon representing one unique card from a deck of four-suit, ace-through-king playing cards, said second face side opposing said first face side.

20. A deck of playing cards as in claim 15 wherein each of said cards is rectangular in shape.

* * * * *